US007426937B2

(12) United States Patent
Doverspike

(10) Patent No.: US 7,426,937 B2
(45) Date of Patent: Sep. 23, 2008

(54) BRACKET SYSTEM FOR SECURING SINGLE-LEVER-VALVES AND ASSOCIATED WATER PIPEWORK TO A SUPPORT BOARD LOCATED INSIDE A WALL

(76) Inventor: Mark Doverspike, P.O. Box 69808, Odessa, TX (US) 79763

( * ) Notice: Subject to any disclaimer, the term of this patent is extended or adjusted under 35 U.S.C. 154(b) by 702 days.

(21) Appl. No.: 11/108,837

(22) Filed: Apr. 19, 2005

(65) Prior Publication Data

US 2005/0229304 A1 Oct. 20, 2005

Related U.S. Application Data

(60) Provisional application No. 60/563,005, filed on Apr. 19, 2004.

(51) Int. Cl.
*E03C 1/042* (2006.01)

(52) U.S. Cl. ..... 137/360; 4/695; 285/64; 248/57; 248/68.1

(58) Field of Classification Search ..... 137/360; 4/695; 285/64; 248/56, 57, 68.1, 70, 74; 52/34

See application file for complete search history.

(56) References Cited

U.S. PATENT DOCUMENTS 2,295,888 A * 9/1942 Bucknell et al. ..... 4/695
2,537,437 A * 1/1951 Aaby ..... 248/57
2,824,312 A * 2/1958 Tortorice ..... 4/695
3,609,774 A * 10/1971 Allgood ..... 4/695
4,654,900 A * 4/1987 McGhee ..... 4/670
4,896,381 A * 1/1990 Hutto ..... 4/695
5,050,824 A * 9/1991 Hubbard ..... 248/57
5,133,094 A * 7/1992 Clarke, Jr. ..... 248/68.1
5,195,553 A * 3/1993 Wright ..... 137/359
5,418,986 A * 5/1995 Warkus et al. ..... 4/670
5,524,727 A 6/1996 Yennie, Jr.
5,906,080 A 5/1999 diGirolamo et al.
6,543,731 B1 * 4/2003 Mercier ..... 248/62
6,547,285 B1 * 4/2003 Schoenweger et al. ..... 285/64
6,640,357 B1 11/2003 Chang
6,666,419 B1 12/2003 Vrame
7,174,580 B1 * 2/2007 Papierniak ..... 4/695

OTHER PUBLICATIONS

U.S. Appl. No. 10/817,878, filed Apr. 6, 2004, Mark Doverspike.
U.S. Appl. No. 10/835,566, filed Apr. 30, 2004, Mark Doverspike.

* cited by examiner

*Primary Examiner*—John Fox

(57) ABSTRACT

A bracket system for securing one or two single-lever-valves and associated water pipes to a support board located inside a wall.

11 Claims, 13 Drawing Sheets

BRACKET SYSTEM FOR SECURING SINGLE-LEVER-VALVES AND ASSOCIATED WATER PIPEWORK TO A SUPPORT BOARD LOCATED INSIDE A WALL

CROSS-REFERENCE TO RELATED APPLICATIONS

This application claims the benefit of priority from U.S. Provisional Patent Application Ser. No. 60/563,005, filed Apr. 19, 2004, the entire contents of which are incorporated by reference herein.

STATEMENT REGARDING FEDERALLY SPONSORED RESEARCH OR DEVELOPMENT

Not Applicable.

FIELD OF THE INVENTION

The present invention relates generally to shower, tub, and/or tub & shower units. More specifically, the invention is directed to a bracket system for securing one or two single-lever-valves and associated water pipes to a support board located inside a wall.

BACKGROUND OF THE INVENTION

New housing, apartment or condo construction and/or remodeling projects require a lot of labor hours and materials. Installing or replacing shower, tub, or shower & tub units frequently involve different skilled workers. For example, architects may provide drawings that include shower, tub, or shower & tub units, which skilled plumbers install in accordance with the architects drawings.

The current trend is for esthetically pleasing shower, tub, or shower & tub units that are fitted with single-lever-valve systems that are hidden from view. However, contemporary shower, tub, or shower & tub designs are often fraught with narrow tolerances that make installing the single-lever-valve difficult.

Therefore, a need exists for efficient and safe ways of installing single-level-valves out of sight of the user.

SUMMARY OF THE INVENTION

A bracket system for securing one or two single-lever-valves and associated water pipes to a support board located inside a wall.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a bracket system for securing one or two single-lever-valves and associated water pipes to a support board located inside a wall.

The numeral 100 denotes the bracket system of the present invention; alphanumerical labels such as 100*a*, 100*b*, and 100*c* represent derivatives or different embodiments thereof.

Figure 1:
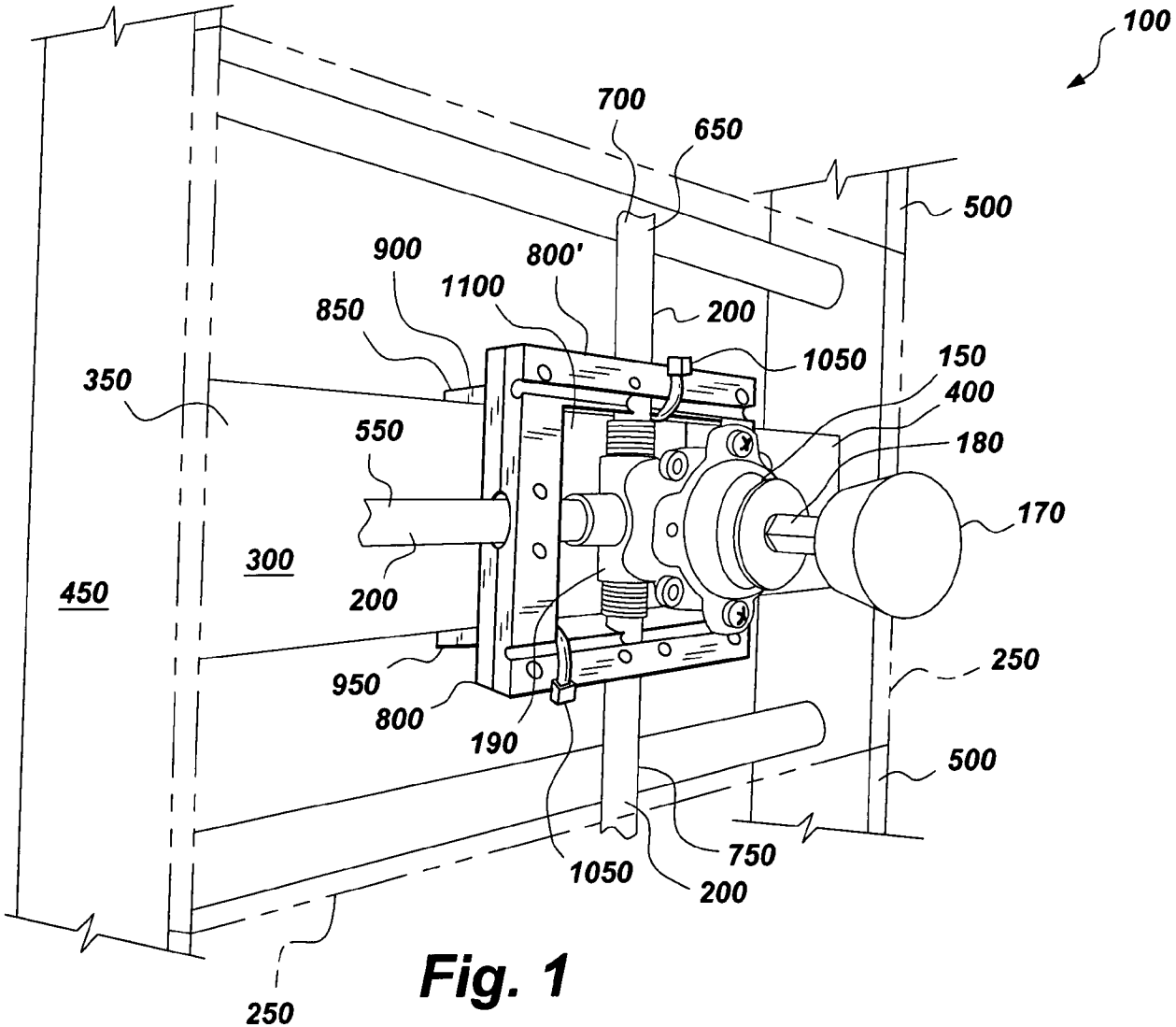
FIG. 1 shows an environmental, perspective view of a first embodiment of a bracket system according to the present invention.

FIG. 1 shows an environmental perspective view of a first embodiment of the present invention. Specifically, the bracket system 100 anchors or secures a first single-lever-valve 150 and associated water pipe hardware 200 inside a wall 250. More specifically, the bracket system 100 anchors or secures first single-lever-valve 150 and water piping 200 to a support board 300 located inside wall 250 and with opposite ends 350 and 400 attached respectively to first and second vertical wall studs 450 and 500. The at least single-lever-valve 150 is operated by handle member 170 via stem 180, which is operably connected to the single-lever-valve 150. The single-lever-valve 150 includes or is operatively connected to a pipe inter-connector member 190, which in turn is in operable communication with associated water pipe hardware 200.

Although vertical studs 450 and 500 are shown in FIG. 1, it should be understood that the bracket system 100 could instead be mounted to a vertical support board, such as a support board mounted between two horizontal studs. The bracket system 100 can be made of any suitable material such as wood, metal, or resilient plastic, or combinations thereof.

The bracket system 100 of the present invention, and embodiments thereof as described herein, is not limited to securing one type of single-lever-valve inside a wall. Non-limiting examples of single-lever-valves include single-lever-valves such as those supplied by the Delta Faucet Company of 55 East 111$^{th}$ Street, PO Box 40980, Indianapolis, Ind. 46280, Moen, Inc. of 25300 Al Moen Drive, North Olmsted, Ohio 44070-8022, Kohler of 444 Highland Drive, Kohler, Wis. 53044, and B & K Faucets, Jacobsen Inc., PO Box 27, Adair, Iowa 50002. Examples of Delta single-lever-valves include the "Monitor 1300" (such as the 1303, 1303WS, and part 1304). Examples of Moen single-lever-valves include the Monticello (Model #: T3129 or T2449) Examples of Kohler single-lever-valves include the K-T6900-2, KT6900-4, K-T6902-2, and K-T6902-4. An example of the Jacobsen, Inc. single-lever-valve, which can be secured using the bracket system 100 of the present invention, includes item #: 121-204. Other non-limiting examples of single-lever-valves that can be secured by the present invention include those used in the Symmons Shower Systems such as model #s: 76-1, 76-1-BRS, and the 76-1-PCB. Still other non-limiting examples of single-lever-valves that can be secured by the present invention include those used in the Sepco Tube & Shower units such as the SEPCO22.

The bracket system 100 also secures the associated water pipe hardware 200 to the support board 300. The associated water pipe hardware 200 typically comprises hot and cold-water supply pipes 550 and 600 (hidden in FIG. 1, but visible in, e.g., FIG. 2C), and at least one water outlet pipe 650. In FIG. 1, the at least one outlet pipe 650 is represented by water outlet pipes 700 and 750. Hot and cold water inlets 550 and 600, and outlets 700 and 750 are thus arranged in a quadrangular pattern. The outlet 700 is typically connected at another end thereof with a showerhead (not shown). Outlet 750 is connected at another end thereof with, for example, a tub spout (not shown). However, at least one water outlet pipe 650 can be a single outlet pipe such as 700 or 750 such that the hot and cold-water supply pipes 550 and 600, and outlets 700 or 750 fan out in three directions as shown in FIG. 2E and accompanying description.

Still referring to FIG. 1, bracket system 100 comprises a first base bracket member 800, at least one board attachment bracket 850 (represented in FIG. 1 by first attachment bracket 900 and second attachment bracket 950), and a complementary first top bracket member 800'. The associated pipe hardware 200 (and the single-lever-valve 150 connected to the associated hardware via member 190) are held in place between first base bracket member bracket 800 and first top bracket member 800'. Optional clasps 1050 can be used to keep the brackets 800 and 800' in a tight fit around the associated pipe hardware 200. The sides of brackets 800 and 800' define a space 1100 for accommodating the hardware member 190 (and hence single-lever-valve 150).

Figure 2A:
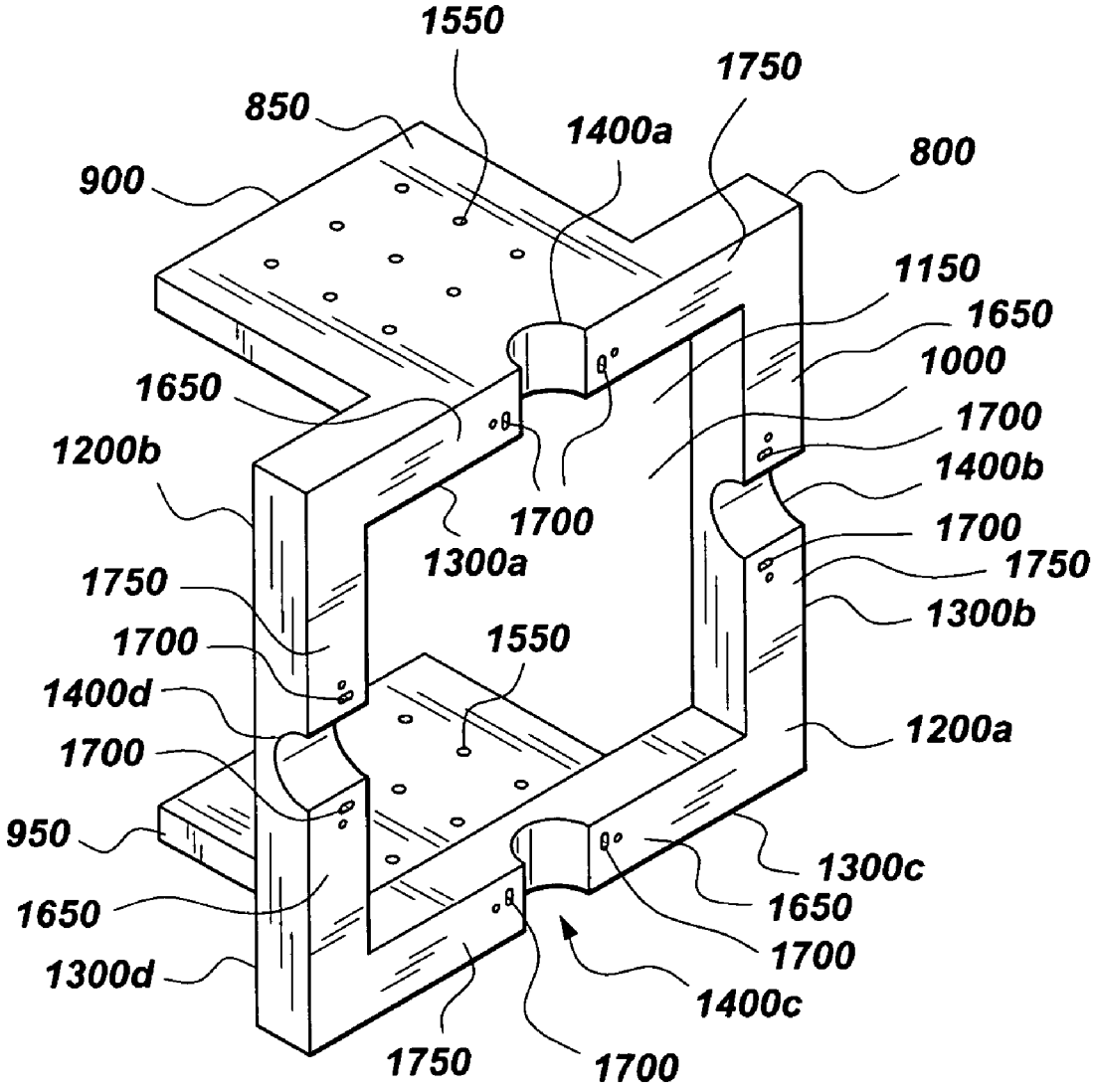
FIG. 2A shows a perspective view of a base bracket member, which forms part of the bracket system shown in FIG. 1.

Referring to FIG. 2A, which shows a perspective view of the base bracket member 800, which forms part of the bracket system 100 as shown in FIG. 1. The bracket 800 is of generally planar configuration having first 1200*a* and second 1200*b* opposite faces, and a first 1300*a*, second 1300*b*, third 1300*c*, and fourth 1300*d* sides that collectively define first central space 1000, here in the form of first central aperture 1020, for accommodating first single-lever-valve 150 or pipe inter-connector member 190 thereof. First 1300*a* and third 1300*c* sides are parallel and opposite each other, and second 1300*b* and fourth 1300*d* sides are parallel and opposite each other. First 1300*a*, second 1300*b*, third 1300*c*, and fourth 1300*d* sides respectively define first 1400*a*, second 1400*b*, third 1400*c*, and fourth 1400*d* notches in first face 1200*a*. Notches 1400*a* and 1400*c* are opposite each other and commonly aligned; notches 1400*b* and 1400*d* are opposite each other and commonly aligned.

Figure 6:
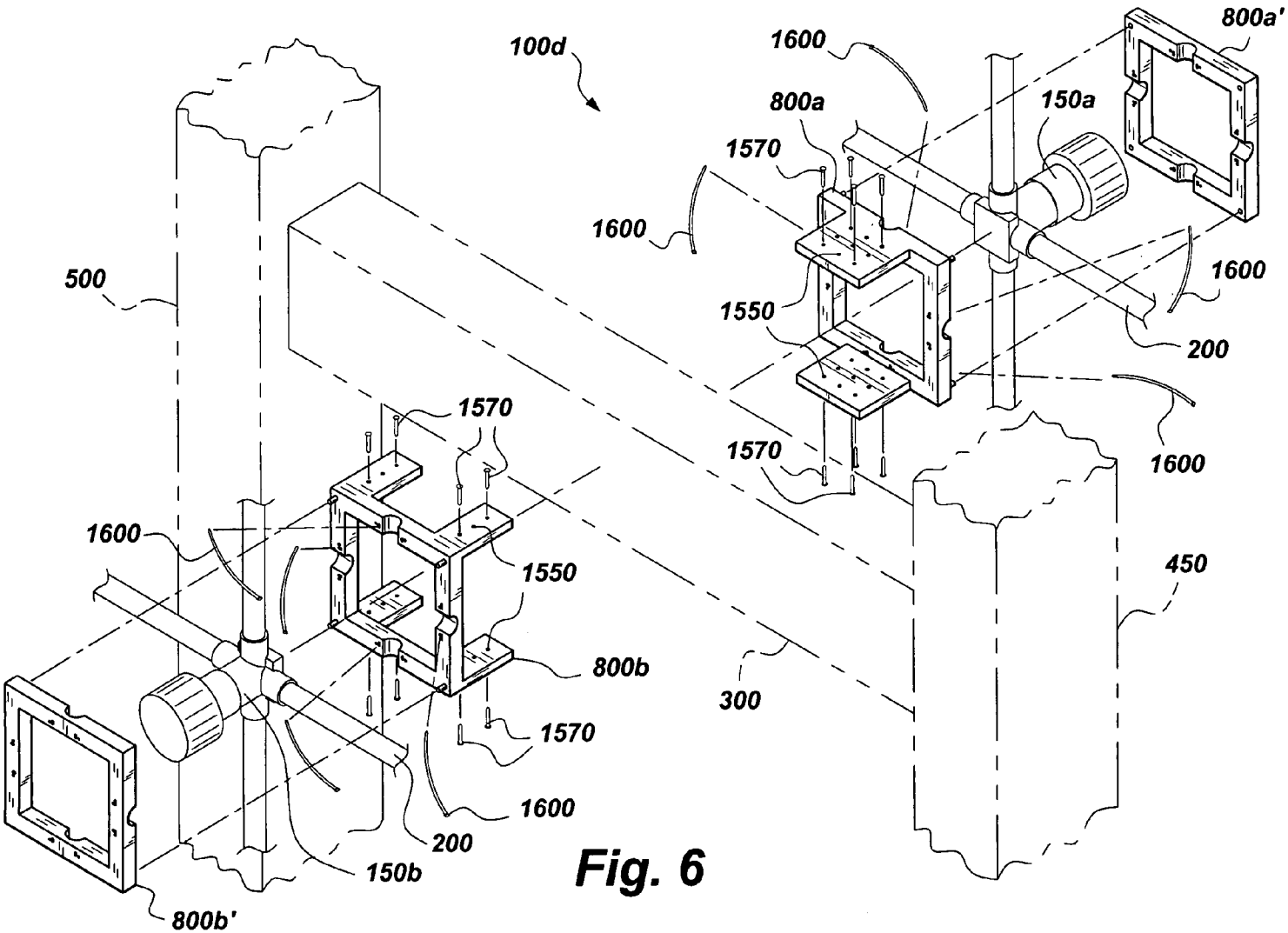
FIG. 6 shows an exploded view of another aspect of the present invention.

Still referring to FIG. 2A, while each of the notches 1400*a*, 1400*b*, 1400*c*, and 1400*d* is shown having a curved shape to accommodate part of the circumference of a water pipe. However, it should be understood that the notches 1400*a* through to 1400*d* can be any suitable recessed shape such as, but not limited to, a square, v-shaped, or rectangular shaped cutout, or combinations thereof. Attachment brackets 850 and 900 define board-securing apertures 1550 through which board attachment members 1570 (see, e.g., FIG. 6) affix bracket member 800 to support board 300.

Figure 2B:
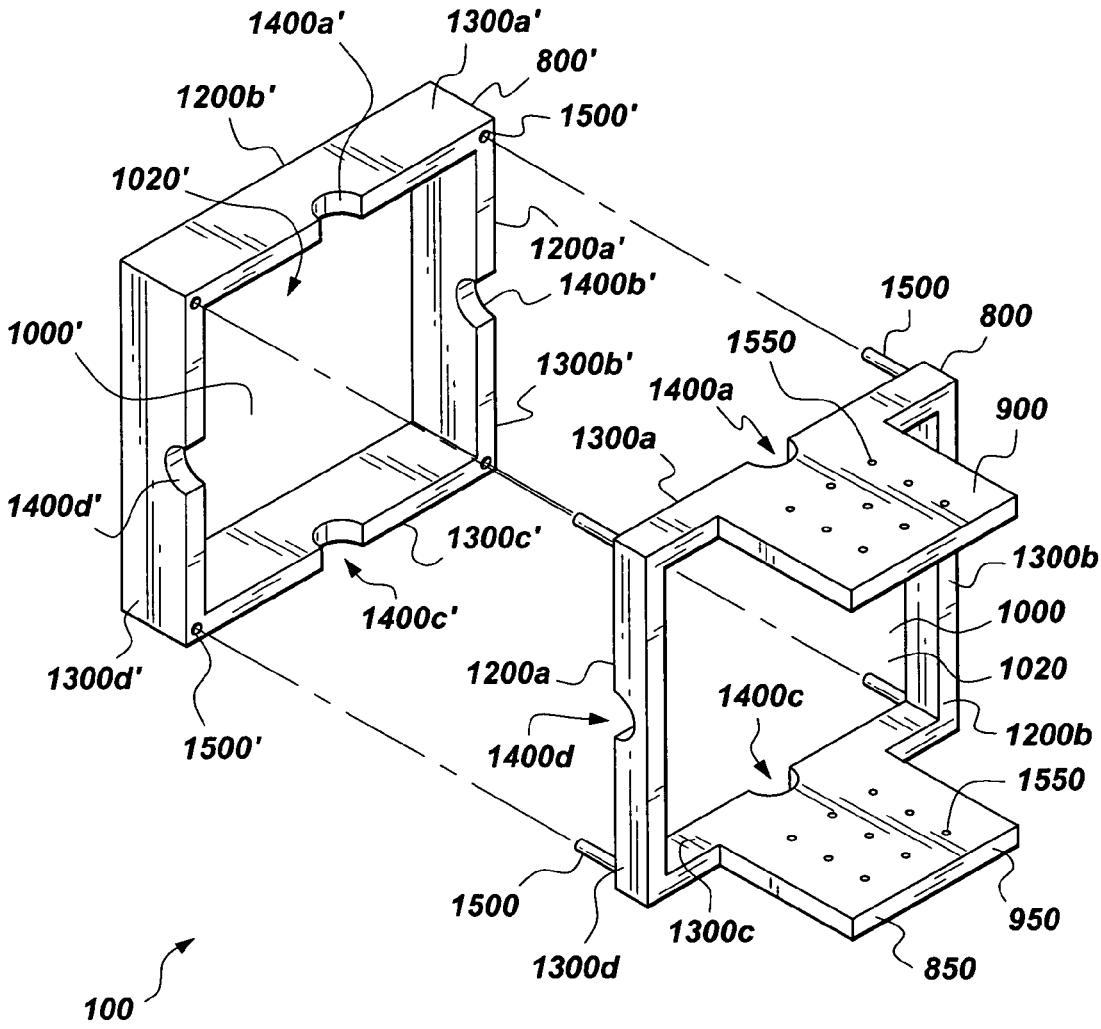
FIG. 2B shows an exploded perspective view of the bracket system shown in FIG. 1.

FIG. 2B shows an exploded perspective view of the bracket system 100 shown in FIG. 1. The bracket system comprises first base bracket member 800 of generally planar configuration, and a complementary first top bracket member 800'. The complementary first top bracket member 800' comprises first and second opposite faces 1200*a*' and 1200*b*', and four sides 1300*a*', 1300*b*', 1300*c*' and 1300*d*', which respectively define therein first complementary or mirror notch 1400*a*', second complementary or mirror notch 1400*b*', third complementary or mirror notch 1400*c*' and fourth complementary or mirror notch 1400*d*' on complementary face 1200*a*', and a second central space 1000' in the form of a second central aperture 1020' to accommodate first single-lever-valve 150. The complementary mirror notches 1400*a*', 1400*b*', 1400*c*' and 1400*d*' align with notches 1400*a*, 1400*b*, 1400*c* and 1400*d*. The defined spaces 1000 and 1000' collectively equate to first central space 1100 shown, for example, in FIG. 1; and first and second apertures 1020 and 1020' collectively equate to first central aperture 1150 shown, for example, in FIG. 1.

Still referring to FIG. 2B, first base and first top bracket members 800 and 800' comprise a mechanism for securing or attaching first base and first top bracket members 800 and 800' together thereby providing the capability to hold first single-lever-valve 150 and associated pipe system 200 in place and secured against the support board 300 as shown in FIG. 1. The mechanism for securing or attaching first base and first top bracket members 800 and 800' together includes a plurality of male attachment pegs 1500 at various locations on face 1200*a* and corresponding female plug inserts 1500' at corresponding locations on face 1200*a*' of the top bracket 800'. Clasps 1050 can be used to keep the brackets 800 and 800' in a tight fit around the associated pipe hardware 200 (see FIG. 1). Attachment brackets 850 and 900 define board-securing apertures 1550 through which board attachment members 1570 (see, e.g., FIG. 6) affix bracket member 800 (and in this embodiment top bracket 800') to board 300.

Figure 2C:
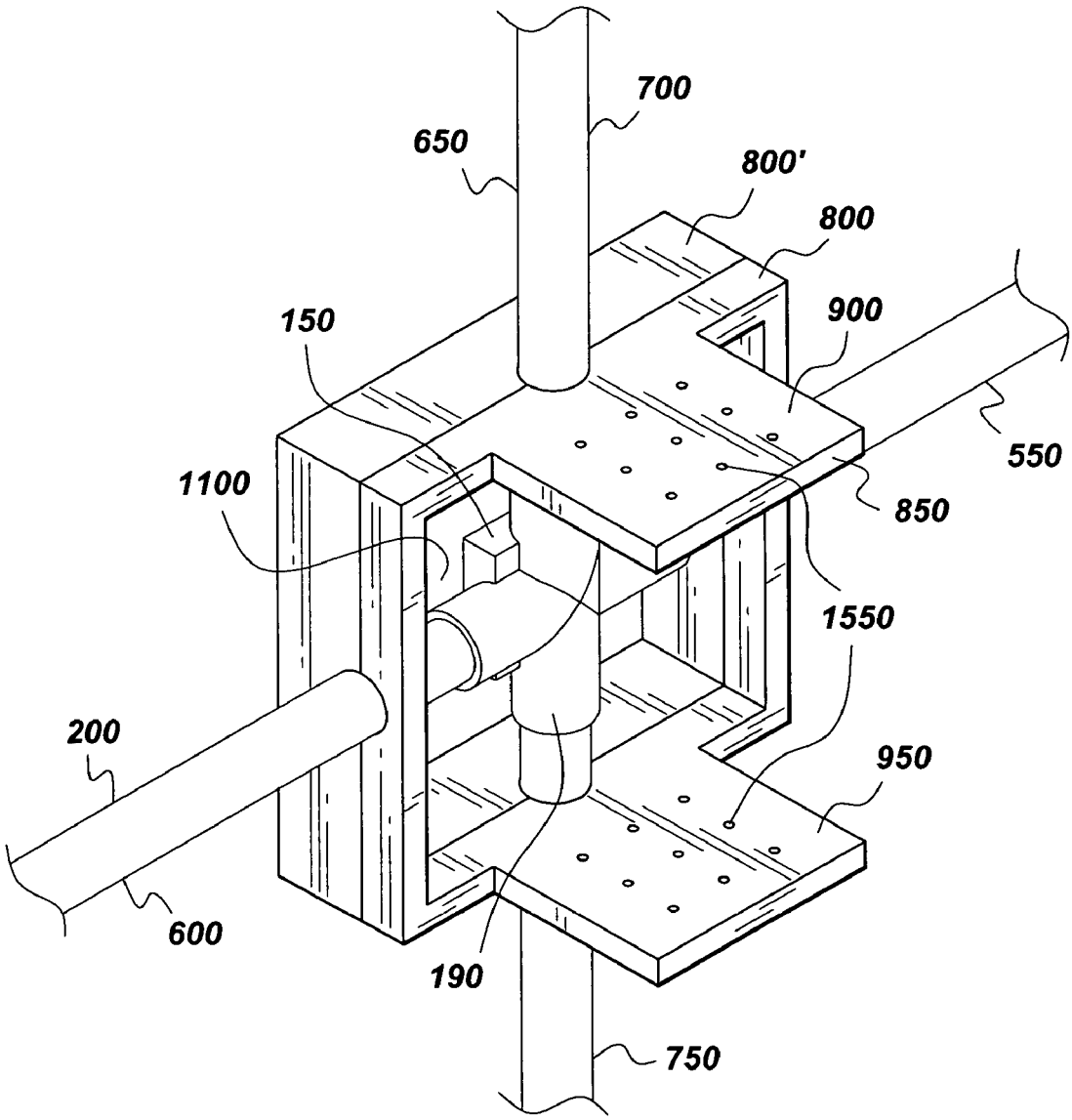
FIG. 2C shows a pair of brackets that forms part of the bracket system shown in FIG. 2B.

FIG. 2C shows the brackets 800 and 800' of FIG. 2B brought together around associated pipe hardware 200. Board attachment members 1570 (shown in FIG. 6), such as, but not limited to, screws, nails, pins, tacks, can be driven through apertures 1550 to attach bracket system 100 to support board 300 (shown in, e.g., FIG. 1).

Figure 2D:
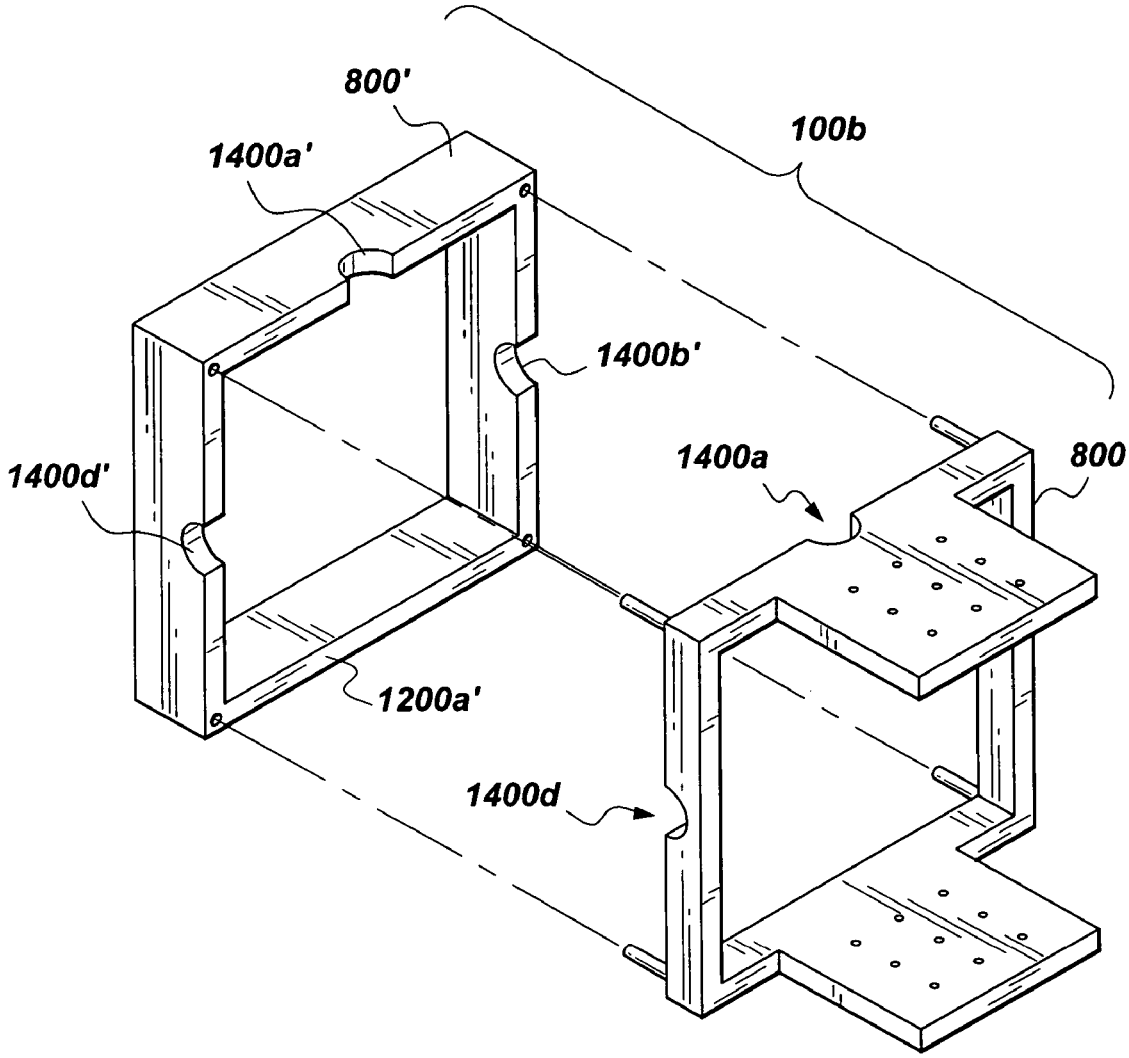
FIG. 2D shows a perspective view of a further embodiment of the bracket system of the present invention.
Figure 2E:
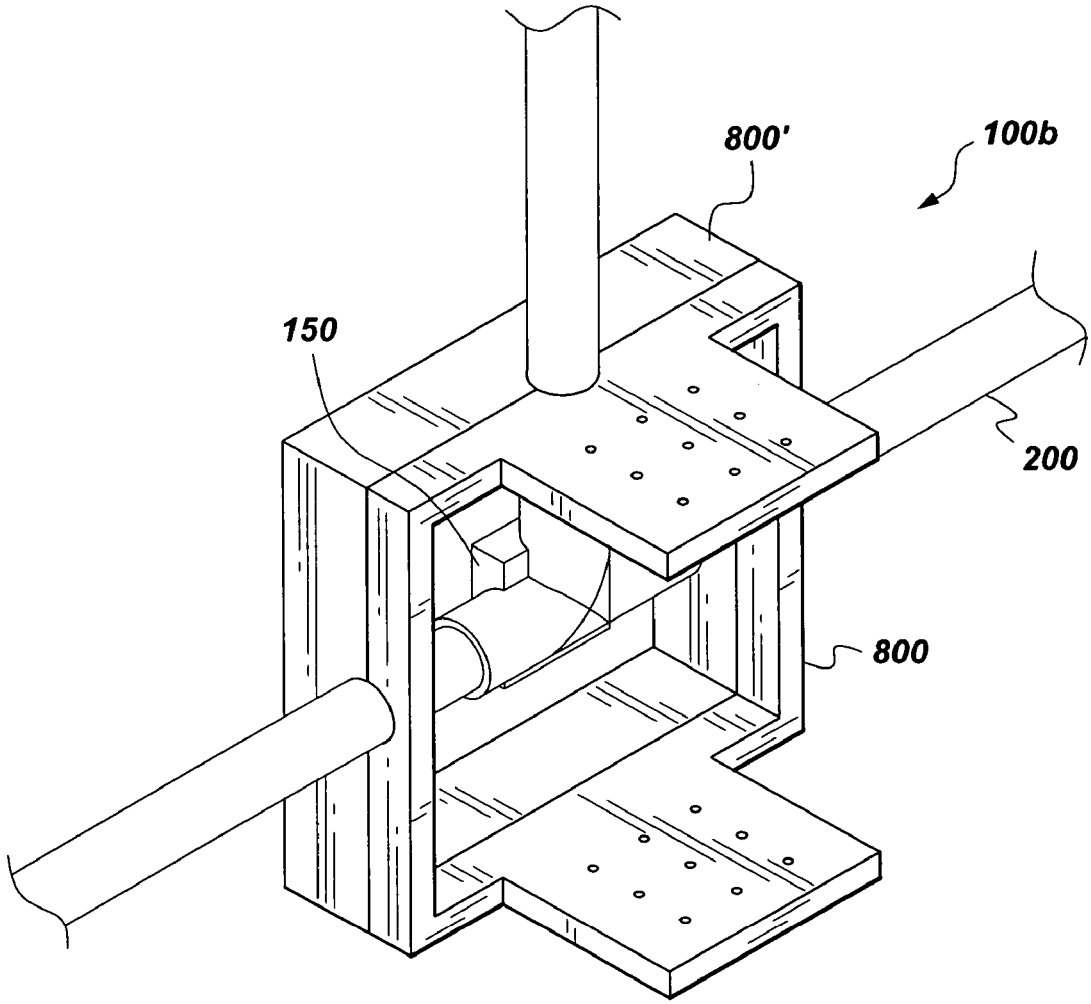
FIG. 2E shows base and top brackets secured to each other thereby enclosing water system hardware and a single-lever-valve.

Referring to FIGS. 2D and 2E, FIG. 2D shows a perspective view of a further embodiment of the bracket system 100 (represented by the alpha-numeric label 100*b*), which includes first base bracket 800 and first top bracket 800' fitted respectively with male plugs 1500 and female plug inserts 1500'. Three notches, 1400*a*, 1400*b*, and 1400*d* are located on face 1200*a* of base bracket 800, and three corresponding notches on face 1200*a*' of top bracket 800'. FIG. 2E shows brackets 800 and 800' secured to each other and thereby enclosing water system 200 and single-lever-valve 150.

Figure 2F:
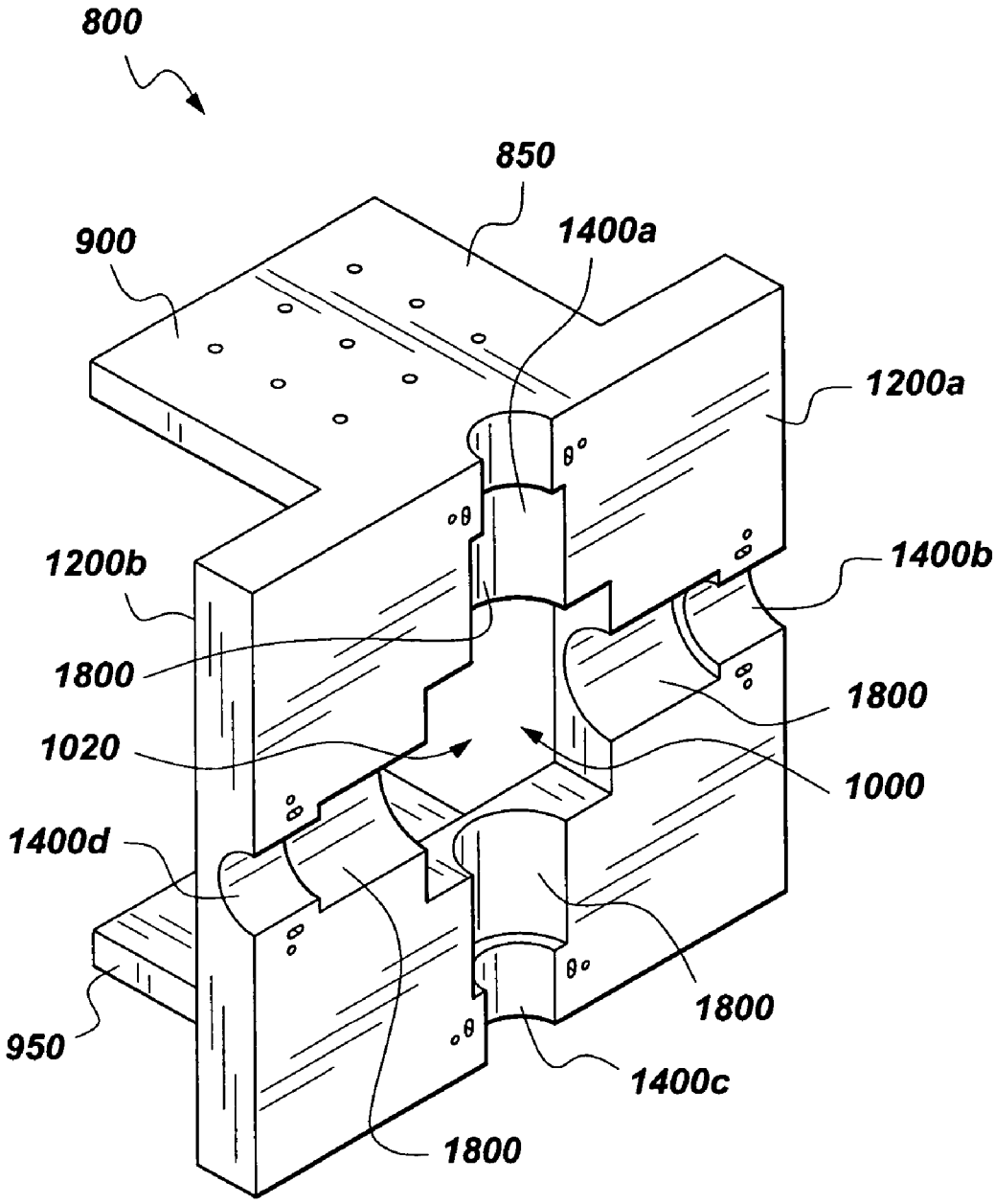
FIG. 2F shows another aspect of the present invention.

FIG. 2F shows yet another version of base bracket 800 in which first, second, third and fourth notches 1400*a*, 1400*b*, 1400*c*, and 1400*d* are etched out of face 1200*a* of base bracket 800. In addition, deeper grooves 1800 are formed in the face 1200*a* to provide a more custom fit for accommodating pipe inter-connector member 190, which typically forms part of a single-lever-valve 150.

Figure 3:
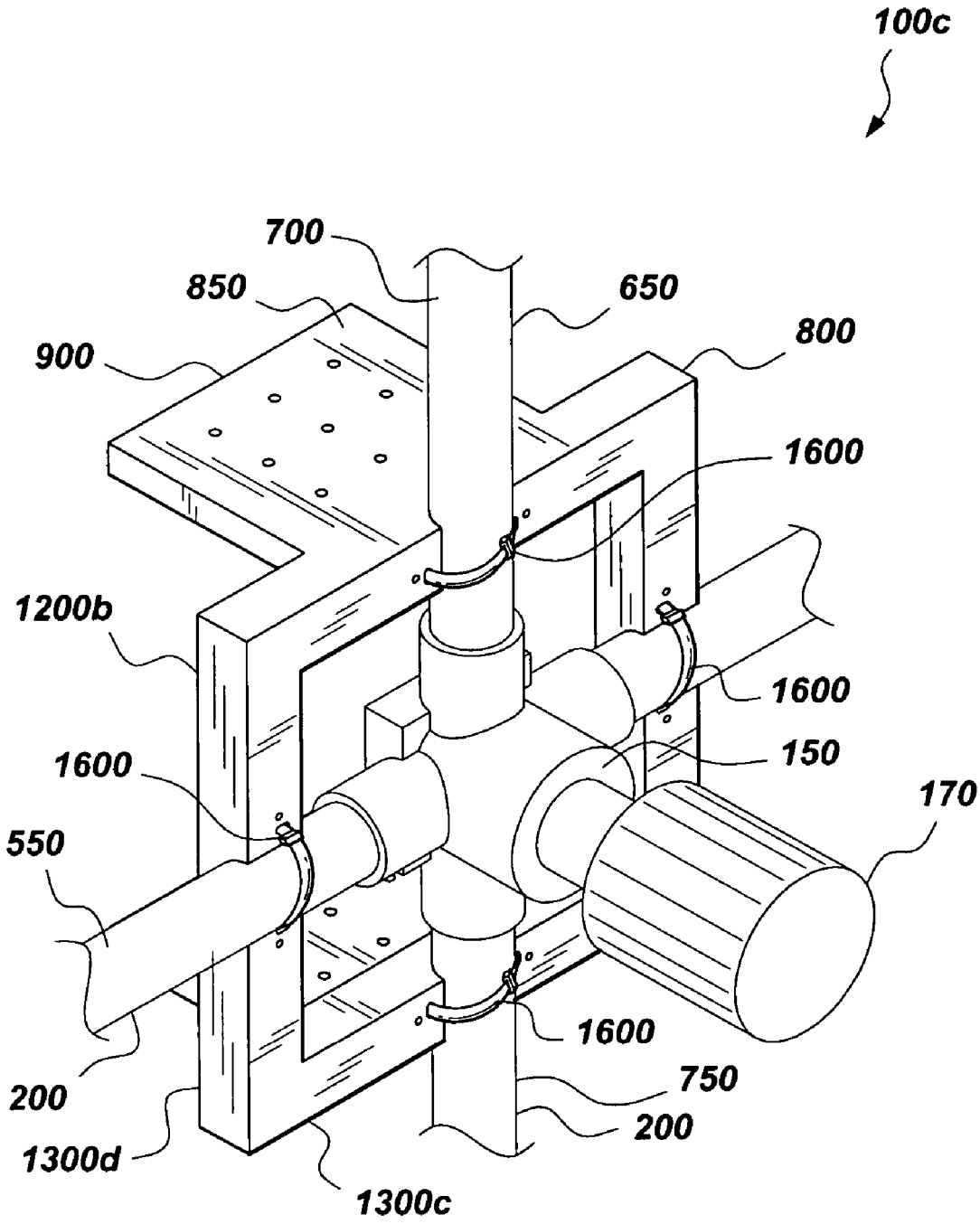
FIG. 3 shows an environmental, perspective view of another embodiment of the present invention.

FIG. 3 shows an environmental perspective view of the second embodiment of the invention 100 (represented by alpha-numeric label 100*c*). Bracket system 100*c* comprises base bracket 800 in combination with ties 1600. Ties 1600 are used to secure associated water pipe hardware 200, and thus single-lever-valve 150 connected to associated water pipe hardware 200, to base bracket 800 and thence to support board 300. More specifically, each first 1400*a*, second 1400*b*, third 1400*c* and fourth 1400*d* notches has first notch side 1650 with at least one notch aperture 1700 disposed therein, and second notch side 1750 with at least one notch aperture 1700 disposed therein.

Figure 4A:
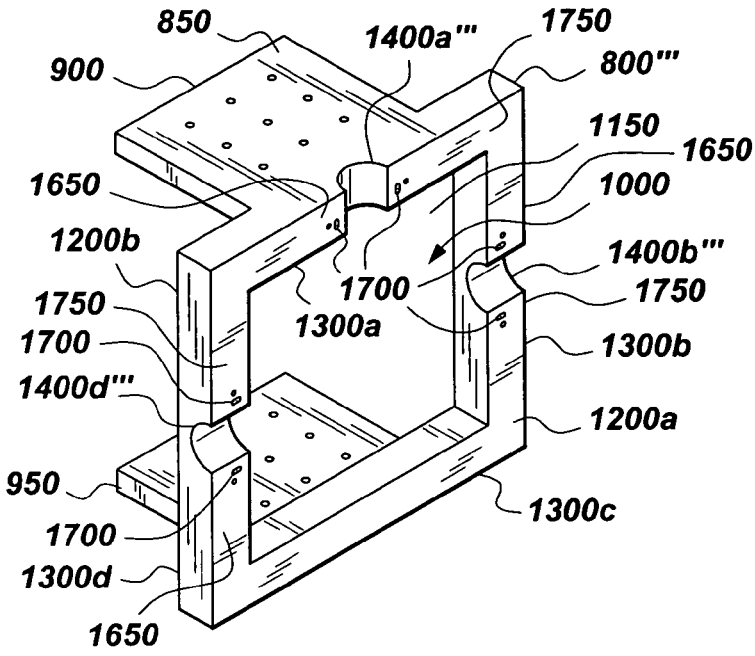
FIG. 4A shows another aspect of the present invention.

Referring to FIG. 4A, which shows a bracket 800 (actually represented by the numeric label 800'''); of particular note are the first 1300*a*, second 1300*b*, and fourth 1300*d* sides that respectively define just three notches: first 1400*a*''', second

1400*b*''' and third 1400*d*''' notches on first face 1200*a*, wherein each notch accommodates part of the circumference of a water pipe, wherein the notch of the second 1300*b* and fourth 1300*d* sides are commonly aligned.

Figure 4B:
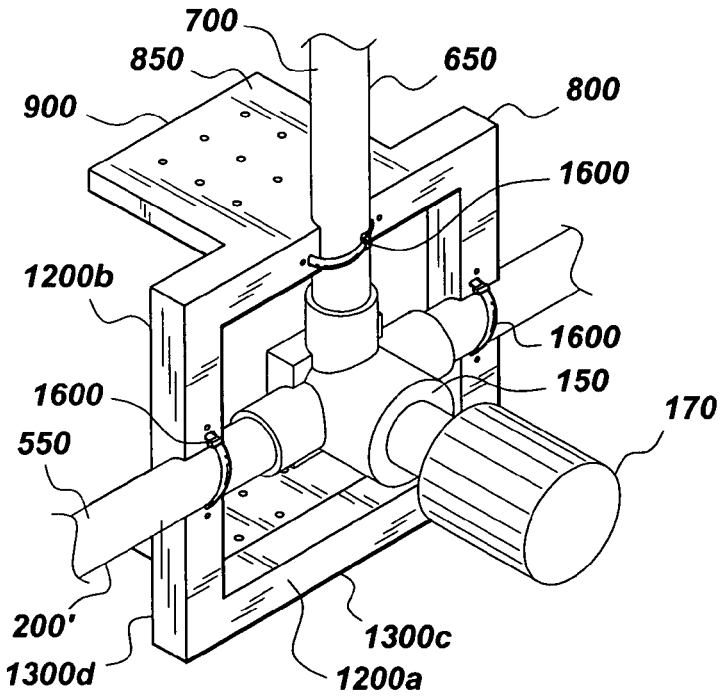
FIG. 4B shows another aspect of the present invention.
Figure 5:
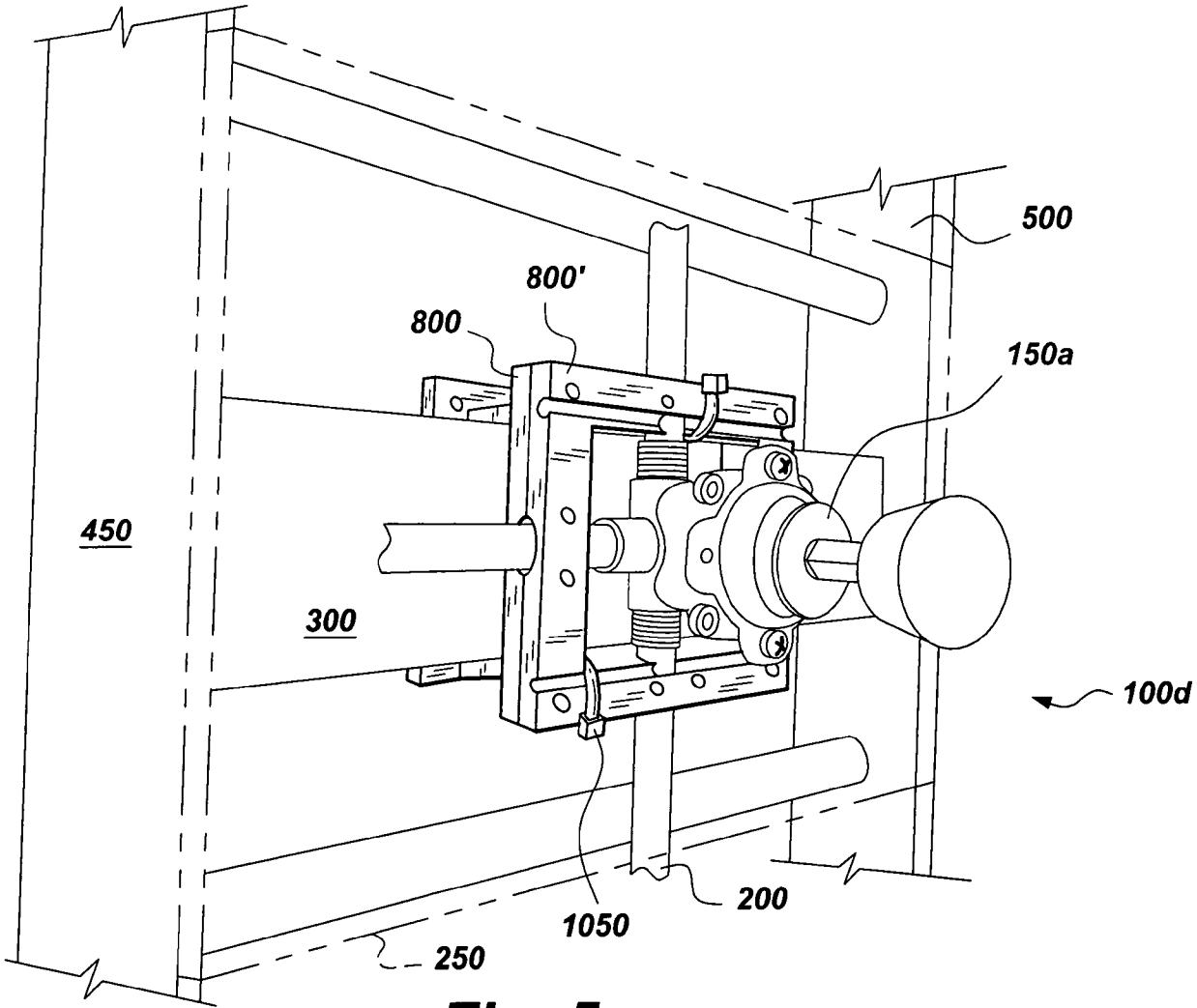
FIG. 5 shows another aspect of the present invention.

Referring to FIG. 4B, which shows associated water pipe hardware 200 (actually represented by the numeric label 200') fitted to face 1200*a* of first base bracket 800'. More specifically, ties 1600 are used to attach the associated water pipe hardware 200' (and hence single-level-valve 150) to the front face 1200*a* of first base bracket 800'.

Figure 7A:
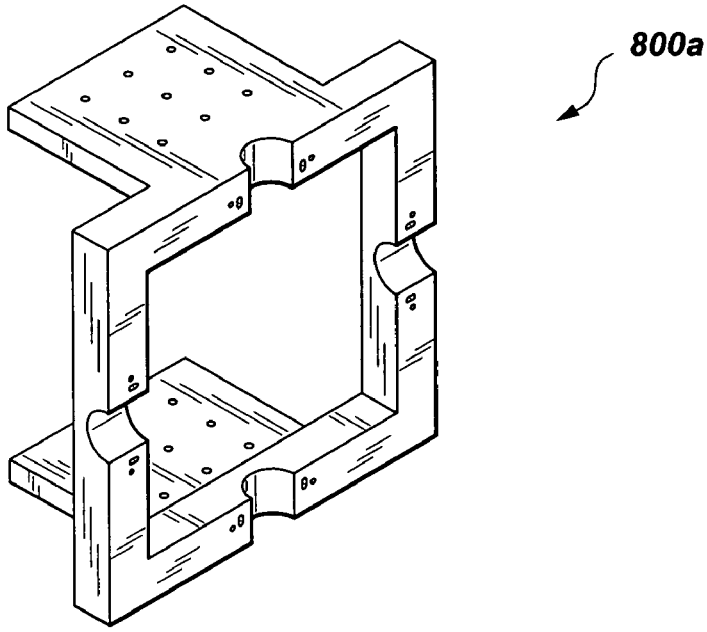
FIG. 7A shows another aspect of the present invention.
Figure 7B:
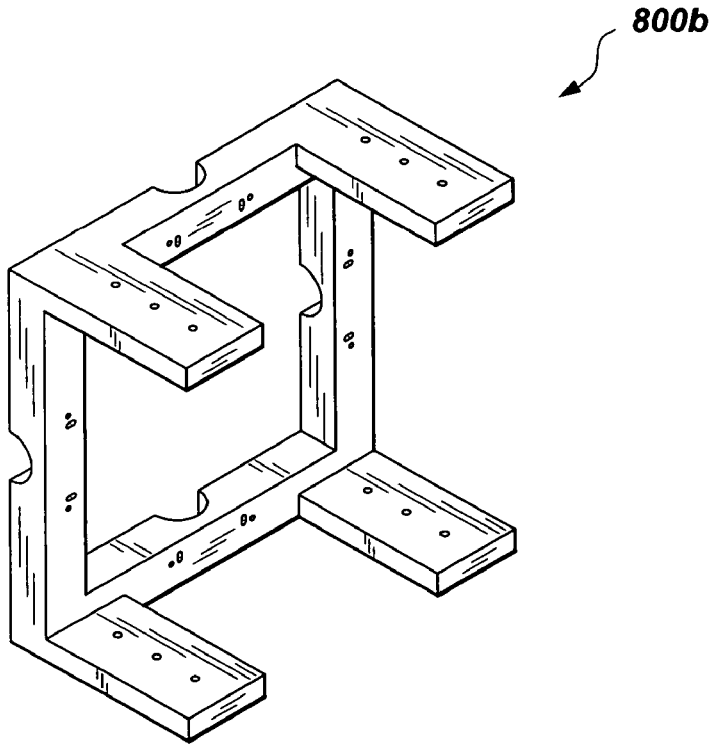
FIG. 7B shows another aspect of the present invention.
Figure 8A:
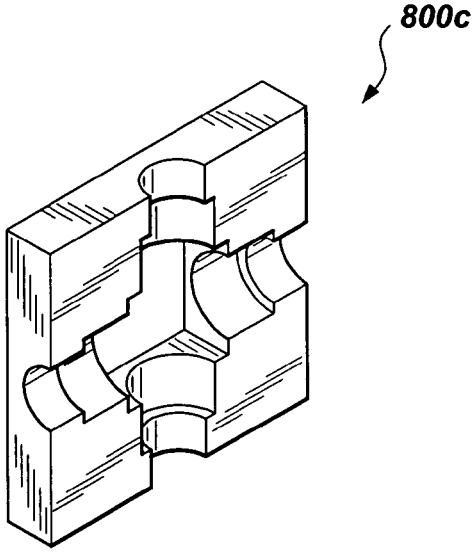
FIG. 8A shows another aspect of the present invention.
Figure 8B:
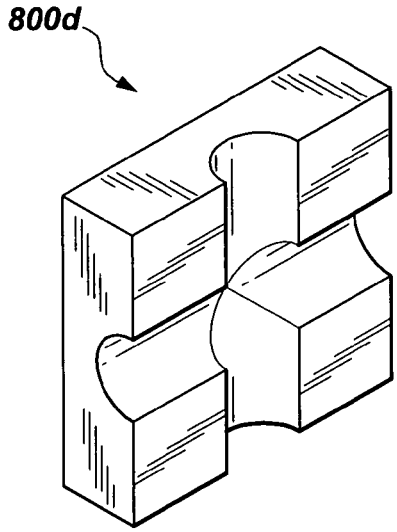
FIG. 8B shows another aspect of the present invention.
Figure 8C:
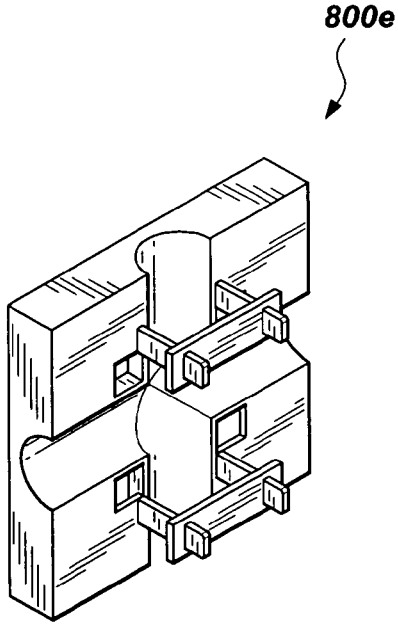
FIG. 8C shows another aspect of the present invention.
Figure 8D:
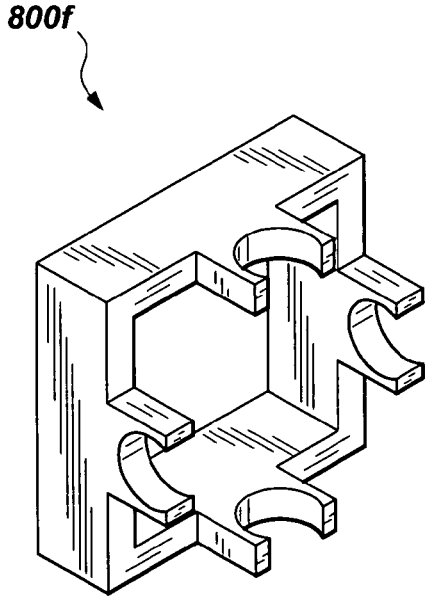
FIG. 8D shows another aspect of the present invention.

Referring to FIGS. 5 through 7B, FIG. 5 shows an environmental perspective view of a further embodiment of the present invention. Specifically, the bracket system 100 (represented by alpha-numeric label 100*d*) is a back-to-back system for fitting first and second single-lever-valves 150*a* and 150*b* (shown in FIG. 6) to both sides of a support board 300. Of particular interest are the complementary base brackets, first base bracket 800*a* and second base bracket 800*b* which are configured to attach to the support board 300 without interfering with each other. FIGS. 7A and 7B show close up views of first and second base brackets 800*a* and 800*b*. It should be understood that base brackets 800*a* and 800*b* can each be used independently to attach the associated water hardware 200 and single-lever-valve 150 to support board 300 inside wall 250. Also, the ties 1600 can be used in place of top brackets 800*a*' and 800*b*' to secure the single-lever-valve 150 and pipe-work 200 to the base brackets 800*a* and/or 800*b*.

FIGS. 8A through 8D show alternative versions of base bracket 800 (represented by alpha-numeric labels 800*c*, 800*d*, 800*e* and 800*f*, respectively).

It is to be understood that the present invention is not limited to the embodiments described above, but encompasses any and all embodiments within the scope of the following claims.

I claim:

1. A bracket system for securing a single-lever-valve and water pipe hardware inside a wall, comprising:

a means for securing a single-lever-valve and water piping to a support board, wherein the water piping comprises hot and cold water supply pipes and at least one water outlet pipe, and wherein the support board is locatable between two vertical wall studs or two horizontal wall studs.

2. A bracket system for securing two single-lever-valves and water pipe hardware inside a wall made up of wall studs, comprising:

a means for securing first and second single-lever-valves and first and second sets of associated water pipe hardware to opposite sides of a support board, wherein each of the first and second sets of water piping comprises independent hot and cold water supply pipes and at least one water outlet pipe.

3. A bracket system for securing single-lever-valve and associated water pipe hardware inside a wall made up of wall studs, comprising:

a first base bracket member of generally planar configuration having first, second, third and fourth sides, wherein said first, second, third and fourth sides define a first central space for accommodating a first single-lever-valve, said first base bracket member having first and second opposite faces, wherein said first and third sides are parallel and opposite each other and said second and fourth sides are parallel and opposite each other, wherein each of said first, second and fourth sides comprises a notch on said first face of said first base bracket member, wherein each notch accommodates part of the circumference of a water pipe, wherein said notch of said second and fourth sides are commonly aligned;

at least one board attachment bracket capable of attaching said first base bracket member to a support board, wherein said at least one board attachment bracket is integral with and projects at a perpendicular angle from said second side of said first base bracket member; and a means for attaching a first associated water piping to notches on said first side of said first base bracket member.

4. The bracket system of claim 3, further comprising a second base bracket member and a means for attaching a second associated water piping and a second single level valve to said second base bracket member.

5. The bracket system of claim 3, further comprises a further notch located in said third side of said first base bracket member, wherein said first and third notches are commonly aligned.

6. The bracket system of claim 5, wherein each notch has first and second sides, wherein said means for attaching associated water piping to said first base bracket member comprises at least one tie aperture on each side of said notches, whereby ties can be threaded through said notch apertures to provide secure pipe connections.

7. The bracket system of claim 5, wherein said means for attaching associated water piping to said first base bracket member comprises a complementary first top bracket member fitted with complementary mirror notches and a second central space to secure the first one lever valve to be fitted to said bracket system, wherein said first base bracket member and said first top bracket member comprise a mechanism for securing said first base bracket member and said first top bracket member together thereby providing the capability to hold the first single-lever-valve and associated pipe system in place and secured against a support board.

8. The bracket system of claim 7, wherein said mechanism for securing said first base bracket member and said first top bracket member together comprises a plurality of male securing pegs and a complementary plurality of female peg inserts.

9. The bracket system of claim 3, wherein each notch has first and second sides, wherein said means for attaching associated water piping to said first base bracket member comprise at least one tie aperture on each side of said first, second, and fourth notches, whereby ties can be threaded through said notch apertures to enable separate pipes to be secured to said notches to provide secure pipe connections to the first single-lever-valve.

10. The bracket system of claim 3, wherein said means for attaching associated water piping to said first base bracket member comprises a complementary first top bracket member fitted with complementary mirror notches and a second central space to accommodate and secure the first one lever valve to be fitted to said bracket system, wherein said first base bracket member and said first top bracket member comprise a mechanism for securing said first base bracket member and said first top bracket member together thereby providing the capability to hold the first single-lever-valve and associated pipe system in place and secured against the support board.

11. The bracket system of claim 3, further comprising:

a second base bracket member of generally planar configuration having fifth, sixth, seventh and eighth sides, wherein said fifth, sixth, seventh and eighth sides define a third central space for accommodating a second single-lever-valve, said second base bracket member having third and fourth opposite sides, wherein said fifth and seventh sides are parallel and opposite each other and said sixth and eighth sides are parallel and opposite each other, wherein said fifth, sixth and eighth sides respectively define fifth, sixth and eighth notches, wherein each notch has a curved shape to accommodate part of the circumference of a water pipe, wherein said notch of said sixth and eighth sides are commonly aligned;

at least one board attachment bracket capable of attaching said second base bracket member to a support board, wherein said at least one board attachment bracket is integral with and projects at a perpendicular angle from said third side of said second base bracket member; and a means for attaching associated water piping to said second base bracket member.

* * * * *